United States Patent [19]

Adams

[11] 4,358,130

[45] Nov. 9, 1982

[54] QUICK-DETACHABLE SECTIONAL SKI

[76] Inventor: Patrick J. Adams, 500 Zimalcrest Dr., Columbia, S.C. 29221

[21] Appl. No.: 209,833

[22] Filed: Nov. 24, 1980

[51] Int. Cl.[3] ..... A63C 5/02

[52] U.S. Cl. ..... 280/603; 292/241; 403/374

[58] Field of Search ..... 280/603, 601; 292/241, 292/257; 403/17, 374

[56] References Cited

U.S. PATENT DOCUMENTS

| | | | |
|---|---|---|---|
| 3,104,888 | 9/1963 | Day et al. | 280/11.13 |
| 3,439,928 | 4/1969 | Noguchi | 280/11.13 |
| 3,589,759 | 6/1971 | Bercheux | 292/241 X |
| 3,596,918 | 8/1971 | Masuda | 280/603 |
| 3,797,838 | 3/1974 | Shurgot et al. | 280/11.13 K |
| 3,801,117 | 4/1974 | Pierce | 280/603 |
| 3,825,360 | 7/1974 | Galich | 280/11.13 K |
| 4,155,568 | 5/1979 | Galich | 280/603 |
| 4,248,449 | 3/1981 | Wilhelmy | 280/603 |

*Primary Examiner*—Joseph F. Peters, Jr.
*Assistant Examiner*—Michael Mar
*Attorney, Agent, or Firm*—Benoni O. Reynolds

[57] ABSTRACT

A sectional ski composed of a forward and a rear section which interlock forward of the boot supporting region of the ski. The sections, preferably made of fiberglass, have male and female coupling members composed of aluminum or other lightweight but strong metal, molded as an integral part of the respective sections. The front coupling member, serving as the rear portion of the front section, consists of a recessed area which also houses a pair of eccentrically mounted cams. These cams engage and disengage the interlocking surfaces of cam slots in both sides of the male lock insert which serves as the front portion of the rear section of the ski. As the two sections are slidably engaged, the cams draw the coupling members together laterally and lock them into an integral unit. The two sections are further held in place by the close tolerances of the vertical and horizontal interfaces of the metal coupling members which are beveled at their points of juncture and by an insert of compressible urethane which serves as a packing gland between the two coupling members.

9 Claims, 9 Drawing Figures

QUICK-DETACHABLE SECTIONAL SKI

BACKGROUND OF THE INVENTION (1) Field of the Invention

This invention relates to skis and more particularly to sectional skis.

(2) Description of Prior Art

Skis usually are quite long and are manufactured in various lengths to accommodate the height of the skier and the use to which the skis will be put. Because of their length, skis are bulky and difficult to transport to and from skiing areas. If transported by automobile, a rack is often used to carry one or more pair of skis on the exterior of the automobile. When transported by aircraft, airlines provide special shipping cartons. Attempts have been made over the years to develop a sectional ski which may be disassembled for transporting and reassembled for use at the skiing area, thus overcoming the problem of transporting the ski to the skiing area. A ski which can be broken down into two or more sections could be easily packed and transported along with other baggage of the skier.

Various sectional skis are known in the prior art but such devices have not been as strong as a conventional ski. Nor has longitudinal stability been assured without decreasing the vertical flexibility necessary to a high performance ski. Most of these sectional skis interlock in the boot support region where they disturb the boot binding. Many of these prior devices are complicated to put together or take apart, requiring inserts, retaining screws or special tools to assemble the ski or tighten the interlock. Other devices utilize clamps which require readjustment from time to time to retain tension. Some coupling members are unwieldly, unsightly and introduce too much rigidity into the ski for good performance. Several of the skis require a great deal of expensive machining to achieve the close tolerances necessary to a tight interlock, adding to the cost of the ski and to the difficulty of manufacturing.

Prior Art known to this inventor includes the following U.S. Pat. Nos.:

3,104,888, 9/1963, Day
3,439,928, 4/1969, Noguchi
3,797,838, 3/1974, Shurgot, et al.
3,825,360, 7/1974, Galich
4,155,568, 5/1979, Galich

BRIEF SUMMARY OF THE INVENTION

The present invention is a quick-detachable sectional ski composed of a forward and a rear section which interlock forward of the boot supporting region of the ski. The interlocking mechanism consists of a pair of eccentrically mounted cams recessed in the female cam housing of the foreward section which engage and disengage the cam slot surfaces provided on both sides of the male lock insert which serves as coupling member for the rear section of the ski. As the male lock insert of the rear section is inserted into the female cam housing of the front section, cam lock arms mounted on top of the ski or in the preferred modification, recessed in each side of the ski, are rotated from a front unlocked position to a rear locked position drawing the male lock insert and the female cam housing laterally together into a strong integral unit. The forward and rear sections are further held tightly in place by the close tolerances between the male lock insert and the female cam housing at their vertical and horizontal interfacing surfaces. Additional strength in the interlock is achieved by the beveling of the interfacing edges and by an insert of compressible urethane which serves as a packing gland between the male lock insert and the female cam housing. Thus, strength and flexibility are achieved by the interaction of the lightweight coupling members bonded to the plastic surfaces of the ski portions of their respective ski sections and by the longitudinal design of the coupling members themselves. In the best mode of the present invention, the forward and rear ski portions of the ski would be made of fiberglass and the male lock insert and female cam housing would be made of cast high tempered aluminum. The cam mechanism would be made of stainless steel. The eccentrically mounted cam mechanism provides the rapid but positive attaching and detaching capability.

OBJECTIVES OF THE INVENTION

The objectives of the present invention are to provide a sectional ski which:

(1) can be quickly and easily assembled or disassembled with no special tools required;
(2) can be assembled or disassembled without the insertion or removal of extraneous screws, bolts, inserts or other retainers;
(3) is lightweight and strong yet retains the flexibility of a high performance ski;
(4) has an interlocking mechanism located so as to be easily accessible to the skier and yet does not interfere with the boot binding;
(5) has an interlocking mechanism which is simple in construction, yet a rugged and positive locking device which will be unaffected by the ice and snow:
(6) has interchangeable sections permitting the lengthening or shortening of the overall ski or the ready replacement of a broken section;
(7) is aesthetically attractive and retains the precision construction and high performance found normally only in non-sectional skis;

DETAILED DESCRIPTION OF THE PREFERRED EMBODIMENT OF THE INVENTION

Figure 1:
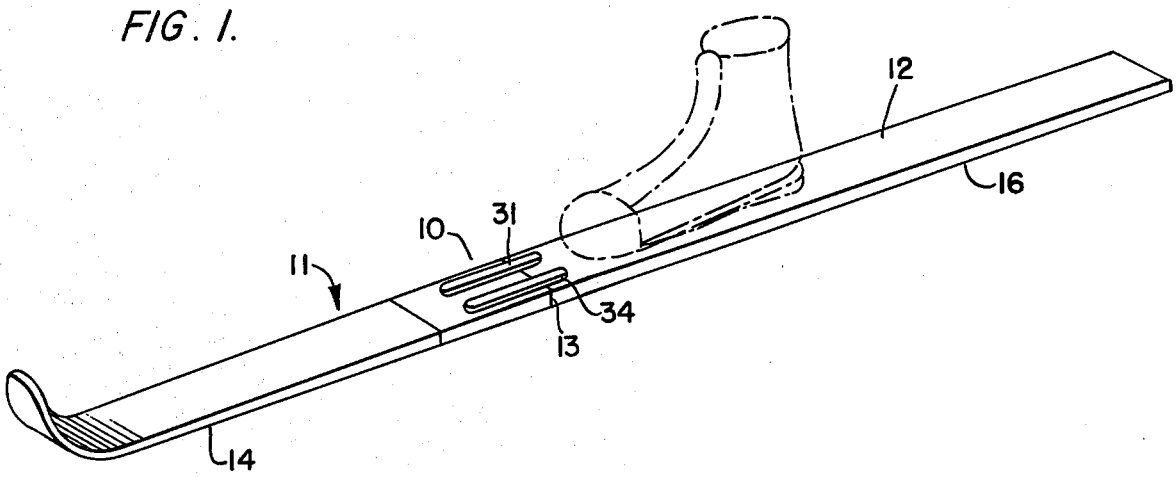
FIG. 1 is a perspective view from the left front of a quick-detachable sectional ski constructed in accordance with the principles of the present invention, showing the juncture of the male lock insert and female cam housing as well as the cam lock arms.
Figure 2:
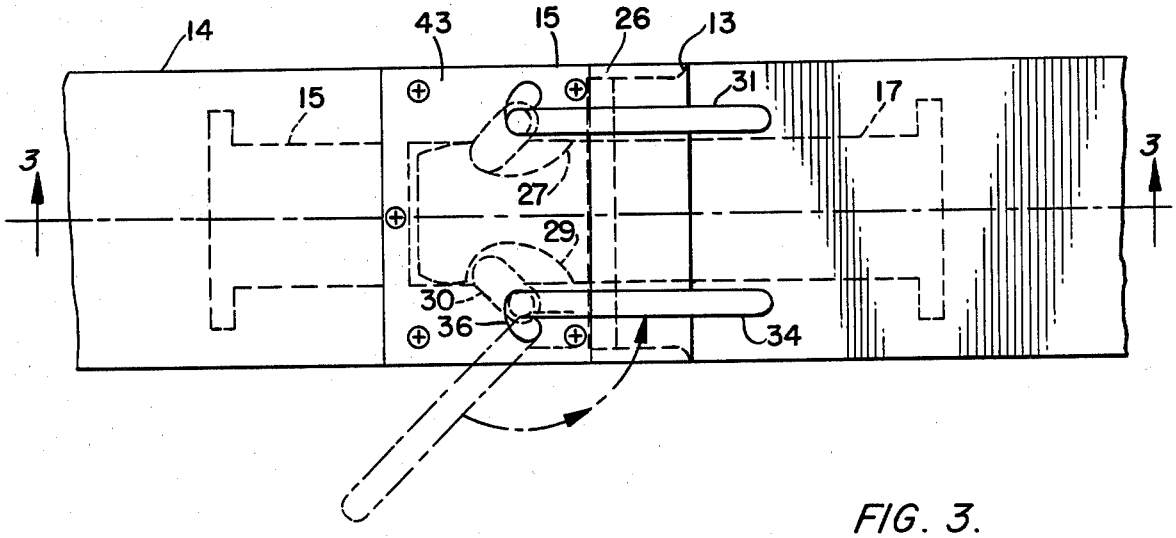
FIG. 2 is a fragmentary plan view of the same present invention showing the position of the male lock insert and female cam housing with respect to the forward and rear ski sections, the cams, the eccentrically mounted cam shaft, the cam lock arms and face plate. Arrows depict the path of the left cam lock arm as it is rotated counter-clockwise into a locking position.
Figure 3:
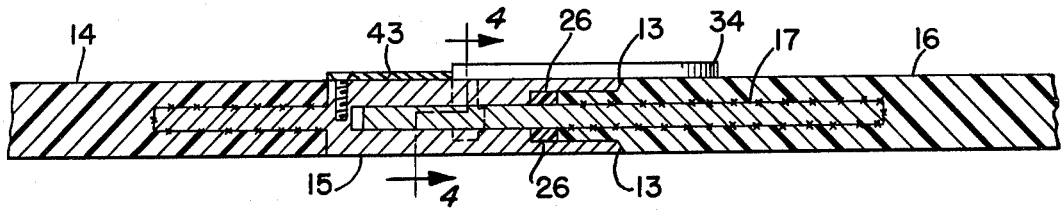
FIG. 3 is a fragmentary longitudinal cross-sectional view of the present invention taken along line 3—3 of FIG. 2 from the direction of the arrows showing by small x's the bonding of the metal male lock insert and female cam housing to the plastic surface (preferably fiberglass) of the ski portions of the sections. Also this drawing shows the vertical position of these coupling members and the compressible urethane gland with respect to the ski sections while interlocked together.
Figure 4:
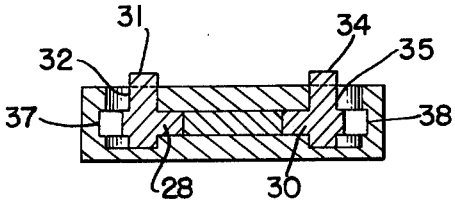
FIG. 4 is a fragmentary transverse cross-sectional view taken substantially along line 4—4 of FIG. 3, showing the relative positions of the cams, cam shafts and cam lock arms recessed in the female cam housing of the coupling member of the forward section of the ski.
Figure 5:
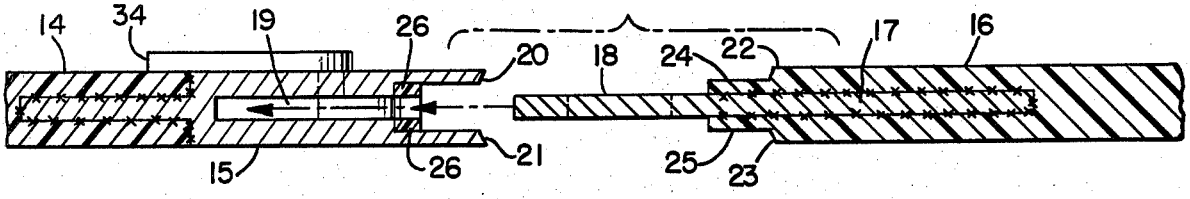
FIG. 5 is a fragmentary longitudinal cross-sectional, exploded view, showing the alignment of the female cam housing of the forward section and the male lock insert of the rear section as the two coupling members are interlocked together in the direction indicated by the arrows.
Figure 6:
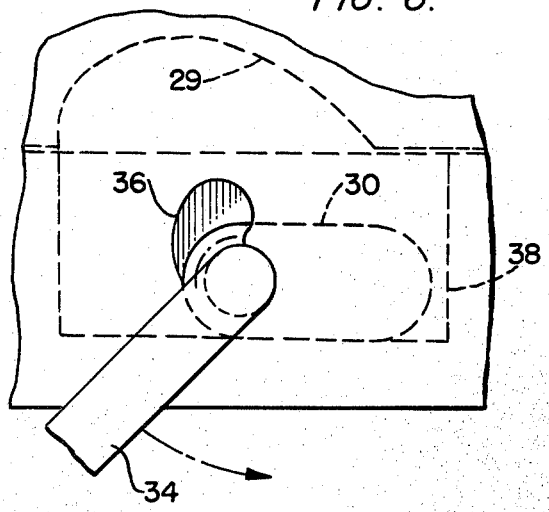
FIG. 6 is a fragmentary view of the left cam, cam shaft and cam lock arm in an unlocked position, depicting the cam engaging and disengaging surface of the male insert and the recess provided in the female cam housing for the travel of the cam.
Figure 7:
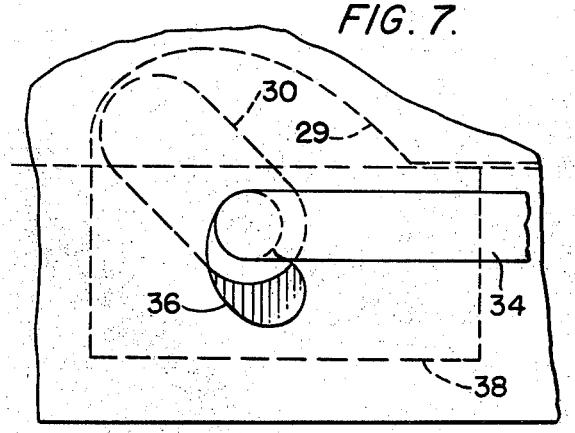
FIG. 7 is a fragmentary view of the same left cam, cam shaft and cam lock arm in a locked position, depicting the cam engaging and disengaging surface of the male lock insert and the recess provided in the female cam housing for the travel of the cam.

The quick-detachable sectional ski is a light, but sturdy device, preferably made of fiberglass and cast high tempered aluminum, which is easily and quickly disassembled for transporting the ski to the ski area and can be rapidly reassembled for immediate use on arrival at the ski area. Throughout the following detailed description of the present invention like reference numerals are used to denote like parts disclosed in the accompanying drawings, FIGS. 1–7. In the drawings of the preferred modification of the present invention, FIGS. 8 and 9, the reference numeral applied to a given part will have a prime affixed to denote a like part of the basic present invention. In its best mode of operation as shown in FIG. 1, the quick-detachable sectional ski is designed so that the interlock mechanism, indicated generally at reference numeral 10, can be actuated by the skier without disturbing the boot binding of the ski. Forward section of the ski, indicated generally as reference numeral 11, joins rear section of the ski, indicated generally as reference numeral 12, at point 13. Forward section 11, consists of forward ski portion 14, preferably made of molded fiberglass, bonded to metal female cam housing 15, which is preferably made of cast high tempered aluminum. Rear section 12 consists of rear ski portion 16, preferably made of molded fiberglass, bonded to male lock insert 17, which is preferably made of cast high tempered aluminum. The interfacing surfaces of forward ski portion 14 are bonded to female cam housing 15 as indicated by the small x's on the left center of FIG. 3. The interfacing surfaces of rear ski portion 16 are bonded to male lock insert 17 as indicated by the small x's on the right center of FIG. 3. Male lock insert 17 has a narrow blade extension 18 which extends forward of rear section 12 and slidably engages with recessed area 19 of female cam housing 15 as best shown in FIG. 5. The tolerances between the horizontal and vertical engaging surfaces of narrow blade extension 18 and recessed area 19 are such that the two members slide together easily yet form a firm interlock. A 1° draft is provided on both sides of narrow blade extension 18. Female cam housing 15 has beveled rear edges at points 20 and 21 to facilitate the slidability of male lock insert 17 as it enters recessed area 19. Similarly, rear ski portion 16 is beveled at points 22 and 23 and tapered surfaces 24 and 25 are provided to facilitate the slidability of male lock insert 17 as it enters female cam housing 15. Tapered surfaces 24 and 25 also add strength and flexibility to the interlock of front section 11 and rear section 12. Compression packing gland 26, preferably made of compressible urethane, is provided at the mouth of recessed area 19 to provide a flexible band around narrow blade extension 18 and to provide a flexible cushion where the front butt edges of tapered surfaces 24 and 25 are seated against the gland when male lock insert 17 and female cam housing 15 are slidably engaged. Recessed area 19 is slightly enlarged at its mouth to accommodate compression packing gland 26 and tapered surfaces 24 and 25 of rear ski portion 16.

Narrow blade extension 18 is provided with cam slot 27 which serves as the engaging and disengaging surface for cam 28 and with cam slot 29 which serves as the engaging and disengaging surface for cam 30. Cam 28 is connected to cam lock arm 31 by cam shaft 32 which is eccentrically mounted in eccentric slot 33. Cam 30 is connected to cam lock arm 34 by cam shaft 35 which is eccentrically mounted in eccentric slot 36. Cam recesses 37 and 38 are provided in female cam housing 15 to permit travel of cams 28 and 30 within the housing. Face plate 43, bolted flush with the upper surface of the ski with recessed bolts, holds the cam mechanism in place.

Figure 8:
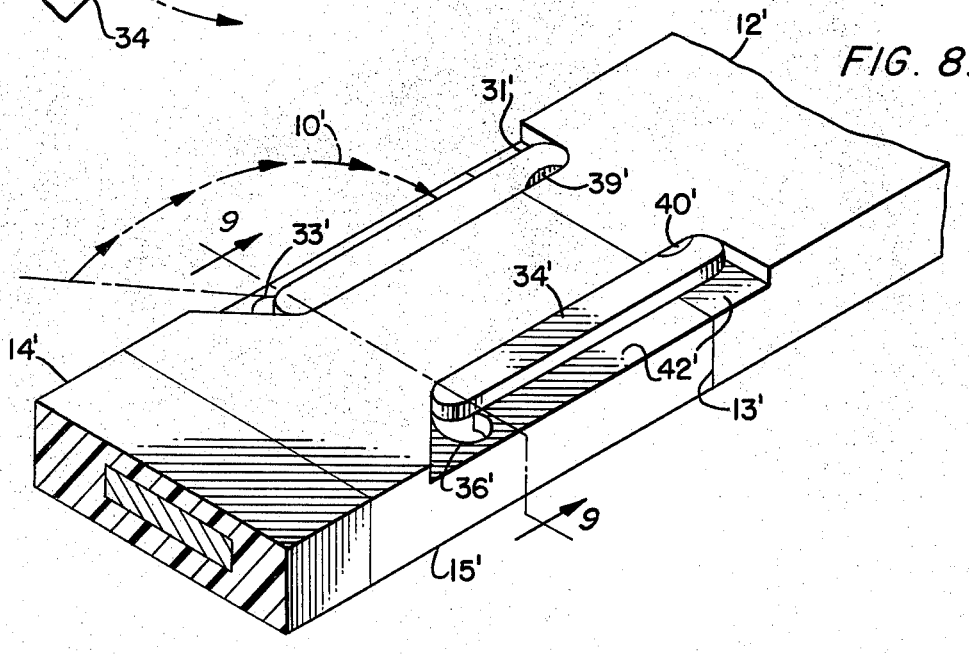
FIG. 8 is a fragmentary perspective view of a preferred modification of the present invention wherein the cam lock arms are positioned flush with the top surface of the ski rather than mounted above the ski surface.
Figure 9:
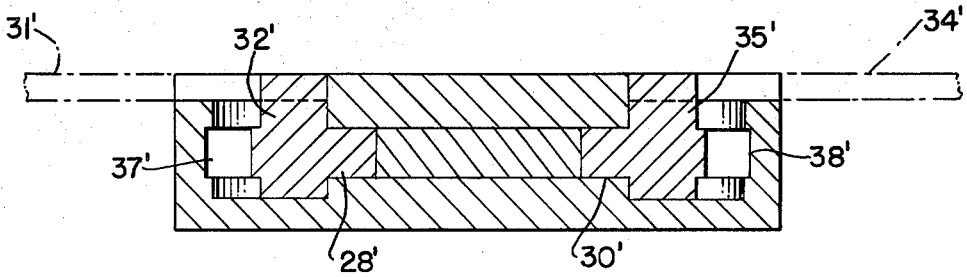
FIG. 9 is a fragmentary transverse cross-sectional view of the preferred modification taken along line 9—9 of FIG. 8 from the direction of the arrows showing the cam lock arms in an open (unlocked) position and the position of the cams, cam shafts and cam lock arms with respect to the female cam housing.

The interlocking mechanism 10′ of the preferred modification of the present invention, as shown in FIGS. 8 and 9, is constructed in exactly the same manner as described above for the present invention except as to the location of cam lock arms 31+ and 34′ and the provision of finger slots 39′ and 40′ to aid in actuating the arms. Rather than mounted atop the surface of female cam housing 15 as in the present invention, cam lock arms 31′ and 34′ are recessed into the right and left sides of female cam housing 15′ and rear section 12′ in such manner that the top of the arms are flush with the top surface of female cam housing 15′ and rear section 12′, yet leaving room for the travel of the arms outwardly to the unlocked position. Cam lock arm recesses 41′ and 42′, slightly longer than the cam lock arms, are provided in female cam housing 15′ and in the forward edge of rear section 12′ for that purpose. The remaining components of the preferred modification are exactly the same as the components of the present invention.

As best illustrated in FIGS. 2,5,6 and 7, in disassembling the present invention in the preferred mode of operation, cam lock arms 31 and 34 are rotated outwardly and forward to disengage cams 28 and 30 from cam slots 27 and 29 in narrow blade extension 18 of male lock insert 17. When cam lock arms 31 and 34 are fully forward in the unlocked position, male lock insert 17 and rear section 12, of which the insert is an integral part, can be withdrawn from recessed area 19 of female cam housing 15, which is an integral part of forward section 11. Forward section 11 and rear section 12 can then be handled as separate, shorter components for packing and travel home from the skiing area. In reassembling the present invention on arrival at a skiing area, the disassembly procedure is reversed. In its preferred mode of operation, as forward section 11 lays flat in front of rear section 12, narrow blade extension 18 of male lock insert 17 is inserted fully into recessed area 19 of female cam housing 15. Cam lock arms 31 and 34 are rotated outwardly and backward to engage cams 28 and 30 against the engaging surfaces of cam slots 27 and 29 in narrow blade extension 18 of male lock insert 17, drawing rear section 12 and its tapered surfaces 24 and 25 tightly against the enlarged mouth of recessed area 19 and against compression packing gland 26. Compression packing gland 26 preserves the interlocking tension between forward section 11 and rear section 12 and provides internal flexibility to the juncture of the sections.

The preferred mode of operation in disassembling and reassembling the preferred modification of the present invention is exactly the same as described above for the present invention. Cam lock arms 31' and 34' are rotated outwardly and forward to disengage cams 28' and 30' from the cam slots of the narrow blade extension in disassembling the preferred modification of the present invention. In reassembling the preferred modification, cam lock arms 31' and 34' are rotated outwardly and backwards to engage cams 28' and 30' against the engaging surfaces of the cam slots on the narrow blade extension. In their fully locked position, cam lock arms 31' and 34' nestle into cam lock arm recesses 41' and 42' flush with the surface of the sectional ski.

I claim:

1. A sectional ski comprising:

forward and rear ski portions; a forward coupling means bonded to said forward ski portion comprising a female cam housing having a recessed area;

a rear coupling means bonded to said rear ski portion comprising a male lock insert having a narrow blade extension which slidably engages with said female cam housing when inserted into said recessed area;

a releasable locking means for locking said forward coupling means and said rear coupling means together comprising cams and cam recesses, eccentrically mounted cam shafts, eccentric slots, and cam lock arms provided in said female cam housing which cams can be rotated so as to engage and disengage the surface of cam slots provided in said narrow blade extension of said male lock insert when said forward and said rear coupling means are mated together.

2. The combination according to claim 1 wherein a compression packing gland is provided at the mouth of said recessed area of said female cam housing to preserve interlocking tension and internal flexibility at the juncture of said female cam housing and said male lock insert.

3. The combination according to claim 2 wherein said compression packing gland comprises compressible urethane.

4. The combination according to claim 3 wherein said female cam housing and said narrow blade extension are cast metal.

5. The combination according to claim 4 wherein said female cam housing and said narrow blade extension are cast high tempered aluminum and said cams, cam shafts and cam lock arms are stainless steel.

6. The combination according to claim 5 wherein said forward ski portion and said rear ski portion are molded fiberglass.

7. The combination according to claim 6 wherein said releasable locking means is located forward of the ski boot binding and said cam lock arms are mounted above the upper surface of said sectional ski.

8. The combination according to claim 6 wherein said cam lock arms are recessed into each side of said female cam housing and into each side of said rear ski portion and flush with the upper surface of said sectional ski.

9. The combination according to claim 8 wherein said cam lock arms are mounted under the ski boot binding.

* * * * *